US006200133B1

(12) United States Patent
Kittelsen

(10) Patent No.: US 6,200,133 B1
(45) **Date of Patent: *Mar. 13, 2001**

(54) ADJUSTABLE CUSTOMIZABLE DENTAL APPLIANCE WITH TRIPLE COMPOSITE STRUCTURE

(75) Inventor: Jon D. Kittelsen, Fridley, MN (US)

(73) Assignee: Big Picture, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/264,847

(22) Filed: Mar. 8, 1999

Related U.S. Application Data

(63) Continuation of application No. 08/766,126, filed on Dec. 16, 1996, now Pat. No. 5,879,126, which is a continuation-in-part of application No. 08/689,253, filed on Aug. 5, 1996, now Pat. No. 5,836,761.

(51) Int. Cl.[7] ..... A61C 3/00
(52) U.S. Cl. ..... 433/6; 128/861
(58) Field of Search ..... 433/6, 34, 37, 433/41, 44, 45; 128/859, 861, 862

(56) References Cited

U.S. PATENT DOCUMENTS

| | | |
|---|---|---|
| 257,038 | 4/1882 | McMann . |
| D. 328,494 | 8/1992 | Schwendeman . |
| D. 343,928 | 2/1994 | Kittelsen . |
| D. 356,188 | 3/1995 | Kittelsen . |
| D. 373,421 | 9/1996 | Brown . |
| D. 397,442 | 8/1998 | Kittelsen . |
| 1,117,928 | 11/1914 | Thurmond . |
| 1,323,832 | 12/1919 | Chige . |
| 1,461,209 | 7/1923 | Bridges . |
| 1,470,888 | 10/1923 | Smedley . |
| 1,487,392 | 3/1924 | Lee . |
| 2,118,980 | 5/1938 | Montgomery . |
| 2,257,709 | 9/1941 | Anderson . |
| 2,423,005 | 6/1947 | Chaiken . |
| 2,630,117 | 3/1953 | Coleman . |
| 2,643,652 | 6/1953 | Cathcart . |
| 2,659,366 | 11/1953 | Savarese . |
| 2,669,988 | 2/1954 | Carpenter . |
| 2,678,043 | 5/1954 | Stark . |
| 2,694,397 | 11/1954 | Herms . |
| 2,702,032 | 2/1955 | Freedland . |

(List continued on next page.)

FOREIGN PATENT DOCUMENTS

| | | |
|---|---|---|
| 1147-583 | 6/1983 | (CA) . |
| 480423 | 8/1929 | (DE) . |

OTHER PUBLICATIONS

American Dental Association, "Mouth Protectors: Give Your Teeth A Sporting Chance".

"Muscular Strength Correlated to Jaw Posrue and the Temporomandibular Joint," Stephen D. Smith, D.M.D., NYS Dental Journal, vol. 44, No. 7, Aug–Sep. 1978.

"Reduction of Stress in the Chewing Mechanism—Part III", William B. May, D.D.S., Basal Facts, vol. 3, No. 1, pp. 22–28.

*Primary Examiner*—Ralph A. Lewis
(74) *Attorney, Agent, or Firm*—Gerald E. Helget; Rider Bennett Egan & Arundel

(57) ABSTRACT

An adjustable and customized dental appliance for the mouth of an athlete is comprised of a composite occlusal posterior pad for each side of the posterior teeth engageable with the occlusal surfaces to space apart the teeth and to absorb shock and clenching stress. An adjustable band or wire is provided connecting the posterior pads together behind the anterior teeth and out of the way of the tongue to maintain the position of the occlusal posterior pads within the mouth during use and to prevent loss of the pads such as by swallowing.

8 Claims, 5 Drawing Sheets

U.S. PATENT DOCUMENTS 2,708,931 5/1955 Freedland .
2,750,941 6/1956 Cathcart .
2,833,278 5/1958 Ross .
2,847,003 8/1958 Helmer .
2,933,811 4/1960 Lifton .
2,966,908 1/1961 Cathcart .
3,016,052 1/1962 Zubren .
3,058,462 10/1962 Greenblum .
3,073,300 1/1963 Berghash .
3,082,765 3/1963 Helmer .
3,107,667 10/1963 Moore .
3,124,129 3/1964 Grossberg .
3,126,002 3/1964 Owens .
3,203,417 8/1965 Helmer .
3,207,153 9/1965 Goldstein .
3,223,085 12/1965 Gores .
3,247,844 4/1966 Berghash .
3,312,218 4/1967 Jacobs .
3,319,626 5/1967 Lindsay .
3,407,809 10/1968 Ross .
3,411,501 11/1968 Greenberg .
3,416,527 12/1968 Hoef .
3,448,738 6/1969 Berghash .
3,457,916 7/1969 Wolicki .
3,485,242 12/1969 Greenberg .
3,496,936 2/1970 Gores .
3,505,995 4/1970 Greenberg .
3,513,838 5/1970 Foderick .
3,518,988 7/1970 Gores .
3,532,091 10/1970 Lerman .
3,682,164 8/1972 Miller .
3,692,025 9/1972 Greenberg .
3,768,465 10/1973 Helmer .
3,864,832 2/1975 Carlson .
3,916,527 11/1975 Linkow .
3,924,638 12/1975 Mann .
3,943,924 3/1976 Kallestad .
4,030,493 6/1977 Walters .
4,044,762 8/1977 Jacobs .
4,063,552 12/1977 Going, Jr. .
4,114,614 9/1978 Kesling .
4,185,817 1/1980 Peterson .
4,211,008 7/1980 Lerman .
4,330,272 5/1982 Bergersen .
4,337,765 7/1982 Zimmerman .
4,348,178 9/1982 Kurz .
4,376,628 3/1983 Aardse .
4,457,708 7/1984 Dufour .
4,490,112 12/1984 Tanaka .
4,519,386 5/1985 Sullivan .
4,568,280 2/1986 Ahlin .
4,591,341 5/1986 Andrews .
4,671,766 6/1987 Norton .
4,672,959 6/1987 May .
4,727,867 3/1988 Knoderer .
4,755,139 7/1988 Abbatte .
4,763,791 8/1988 Halverson .
4,765,324 8/1988 Lake, Jr. .
4,791,941 12/1988 Schaefer .
4,793,803 12/1988 Martz .
4,799,500 1/1989 Newbury .
4,810,192 3/1989 Williams .
4,848,365 7/1989 Guarlotti .
4,867,147 9/1989 Davis .
4,976,618 12/1990 Anderson .
4,977,905 12/1990 Kittelsen .
5,031,611 7/1991 Moles .
5,031,638 7/1991 Castaldi .
5,063,940 11/1991 Adell .
5,076,785 12/1991 Tsai .
5,082,007 1/1992 Adell .
5,112,225 5/1992 Diesso .
5,117,816 6/1992 Shapiro .
5,152,301 10/1992 Kittelsen .
5,154,609 10/1992 George .
5,165,424 11/1992 Silverman .
5,194,003 3/1993 Garay .
5,194,004 3/1993 Bergersen .
5,234,005 8/1993 Kittelsen .
5,235,991 8/1993 Minneman .
5,259,762 11/1993 Farrell .
5,277,203 1/1994 Hays .
5,293,880 3/1994 Levitt .
5,297,960 3/1994 Burns .
5,299,936 4/1994 Ueno .
5,302,117 4/1994 Kraut .
5,313,960 5/1994 Tomasi .
5,316,474 5/1994 Robertson .
5,320,114 6/1994 Kittelsen .
5,323,787 6/1994 Pratt .
5,336,086 8/1994 Simmen .
5,339,832 8/1994 Kittelsen .
5,353,810 10/1994 Kittelsen .
5,365,946 11/1994 McMillan .
5,385,155 1/1995 Kittelsen .
5,386,821 2/1995 Poterack .
5,401,234 3/1995 Libin .
5,447,168 9/1995 Bancroft .
5,460,527 10/1995 Kittelsen .
5,513,656 5/1996 Boyd, Sr. .
5,566,684 10/1996 Wagner .
5,584,687 12/1996 Sullivan .
5,718,575 2/1998 Cross, III .
5,836,761 11/1998 Belvedere .
5,865,619 2/1999 Cross, III .
5,879,155 * 3/1999 Kittelsen ..... 433/6

* cited by examiner

ADJUSTABLE CUSTOMIZABLE DENTAL APPLIANCE WITH TRIPLE COMPOSITE STRUCTURE

This application is a continuation of co-owned patent application Ser. No. 08/766,126, filed Dec. 16, 1996, now U.S. Pat. No. 5,879,126 which is a continuation-in-part of co-owned application Ser. No. 08/689,253, filed Aug. 5, 1996, now U.S. Pat. No. 5,836,761 for an adjustable, customized dental appliance.

BACKGROUND OF THE INVENTION

This invention relates generally to an adjustable, customized dental appliance for use by athletes and, more particularly, to an appliance that spaces apart the teeth to absorb shock and clenching stress, to space apart the anterior teeth of the lower and upper jaws to facilitate breathing and speech, to lessen condylar pressure, force and impact upon the cartilage and temporomandibular joints, the arteries and the nerves, and to further increase body muscular strength and endurance.

Almost all athletes such as body builders, weight lifters, baseball batters, golfers, football players, hockey players and bowlers clench their teeth during exertion which results in hundreds of pounds of compressed force exerted from the lower jaw onto the upper jaw. This clenching force is unevenly transmitted through the jaw structure into the connective tissues and muscles of the lower jaw and further into the neck and back. This can result in headaches, muscle spasms, damage to teeth, injury to the temporomandibular joint, and pain in the jaw. Furthermore, clenching the teeth makes breathing more difficult during physical exercise and endurance when breathing is most important.

The glenoid fossa located directly ventral to the external auditory meatus is the hollow receptacle for the mandibular condyle or condylar process.

The articulation of the condyle in the glenoid fossa is a pure hinge activity around a horizontal axis through the initial 4–10 mm of the opening of the human mouth. After this initial pure hinged function, the continuted opening of the mouth becomes a transitory action of the condyle moving forward or ventrally in the glenoid fossa as the continued opening of the mouth is accomplished by the mandible moving in a forward or ventral position. This action of the temporo-mandibular joint (TMJ) is unique in mammals, and is the start of aberrations in the human TMJ.

If through trauma, pathology, or habit, the articular surface of the condyle has been altered in its ideal anatomic form, and/or the meniscus is damaged or perforated, an arthritic condition can result, which damages the articular surfaces and associated cartilageanous tissues which lubricate and cushion these two bones, the fossa and the condyle.

When the individual attempts to utilize the supportive musculature and skeletal components of the body during strength utilization, or in a stress situation, the muscles of mastication contract in response to this increased stress, and clench the dentition or teeth to such a degree as to compress the structures of the TMJ.

The position of the major muscles of mastication, the masseter and the temporals, pull the mandible up and dorsally or back, so that the condyle is driven into the glenoid fossa to a greater degree than in any other situation, and against these altered structures.

In an absolutely ideal anatomic situation where the structures of the TMJ have not been altered, this clenching will have minimal effect on the utilization of the human body's skeletal muscles.

Since the negative effects of changes in the TMJ are not known without extensive radiographic, magnetic resonance investigation, and/or surgical analysis, a great percentage of the population will experience a limiting effect by the autonomic nervous system, that system which regulates the stress evaluation by the brain, to limit the clenching action of the jaws.

By placing an appliance of a non-yielding material between the posterior teeth, which will open the mouth from 1 to 5 mm by preventing the mandible from being pulled into the condylar-fossa pressure position, the clenching action of the jaws will not over-burden the TMJ or drive the condyle into the glenoid fossa, until this over-burden causes the brain to direct the skeletal muscles to limit their utilization.

Furthermore, there is a suture line in the dome of all human glenoid fossae which may be the major component limiting the result of the clenching in the TMJ. As certain individuals clench in increased strength and/or stress activities, this pressure on the glenoid fossa dome can cause edema to result. If an individual partaking in a physical activity sustains a traumatic insult to the TMJ, and an edematous condition results, the balance centers of the skull can be affected and the strength potential will be reduced unless the clenching activity is controlled to prevent the compression of the condyle in the fossa.

There is a condition called bruxism which is an unknown causation, idiopathic movement of the mandible, resulting in grinding of the teeth. This condition is particularly troublesome during sleep, because during sleep the muscles of the jaw contract more than while the person is awake and this can cause physical and physiological damage to the masticating apparatus (bone, teeth, muscles, and soft tissues). This damage may cause the capsular system around the TMJ to shrink so that the person cannot open the jaws. An appliance may be inserted in the mouth to prevent bruxism, but where the condition has progressed to the point where the jaws can only be slightly opened, the appliance must be insertable into the mouth through this narrow opening.

It has also been found that a dental appliance which allows the wearer to clench the teeth can contribute to the alleviation of stress. Such a device may also be a rehabilitation of recovery aid after general surgery by reducing levels of bodily stress. Finally, a clenching device may have use as a birthing aid for women.

There is a need for an adjustable and customized dental appliance for the mouth of an athlete which will absorb shock and clenching stress otherwise transferred from the connective tissues, the muscles and lower jaw to the upper jaw, neck and back, will space apart the anterior teeth of the lower jaw from the anterior teeth of the upper jaw to facilitate breathing and speech, and will lessen condylar pressure, force and impact upon the cartilage, and temporomandibular joints, arteries and the nerves.

Also, it is desirable that the dental appliance can be manufactured in one size and easily adjusted and customized to the mouths of almost all wearers, from a child to an adult.

SUMMARY OF THE INVENTION

An adjustable and customized dental appliance for the mouth of an athlete is comprised of a composite occlusal posterior pad for each side of the posterior teeth engageable with the occlusal surfaces to space apart the teeth and to absorb shock and clenching stress. An adjustable band or wire is provided connecting the posterior pads together behind the anterior teeth and out of the way of the tongue to maintain the position of the occlusal posterior pads within the mouth during use and to prevent loss of the pads such as by swallowing.

A principal object and advantage of the present invention is that the appliance protects the teeth, jaws, gums, connective tissues, back, head and muscles from teeth clenching forces typically exerted during athletic activity.

Another principal object and advantage of the present invention is that it is adjustable both side to side, fore and aft, twistable and bendable to fit the mouth of almost all wearers while at the same time being securely retained by the anterior teeth and posterior teeth.

Another object and advantage is the wire is adjustable to fit and suitably may have a shape memory should the band become bent during storage.

Another object and advantage of the present invention is that it facilitates breathing and speech during strenuous physical activity such as in power lifting or bodybuilding.

Another object and advantage of the present invention is that the appliance places the lower jaw in the power position moving the condyle downwardly and forwardly away from the nerves and arteries within the fossae or socket to increase body muscular strength, greater endurance, and improved performance by the appliance user.

Other objects and advantages will become obvious with the reading of the following specification and appended claims with a review of the figures.

DETAILED DESCRIPTION OF THE PREFERRED EMBODIMENTS

Figure 1:
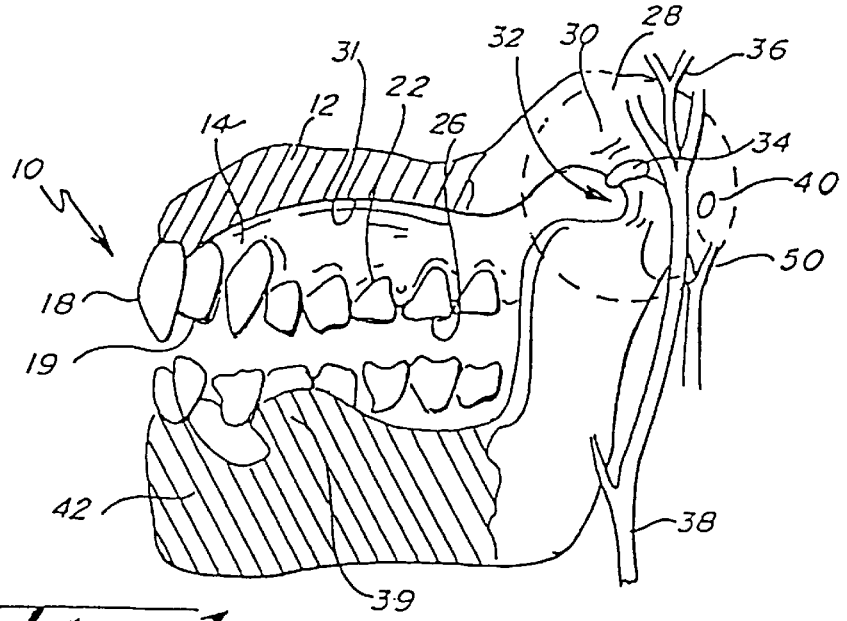
FIG. 1 is a maxillary mandibular buccal or partial side elevational view of the jaws and temporomandibular joint of a user of a dental appliance of the present invention.
Figure 1A:
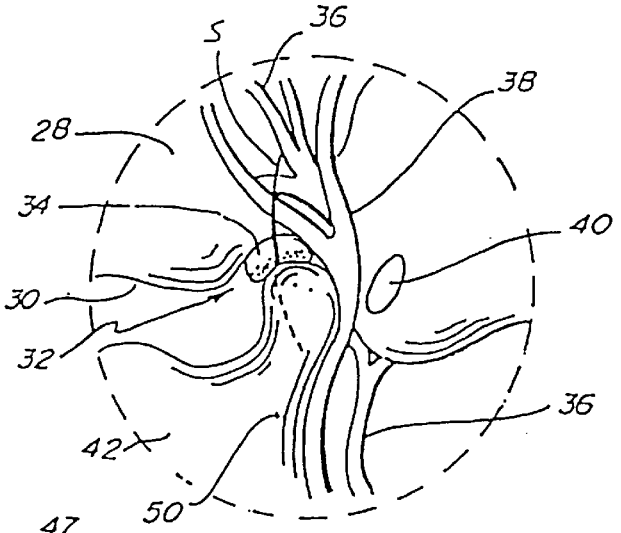
FIG. 1A is an enlarged view of the circled temporomandibular joint portion of FIG. 1.
Figure 1B:
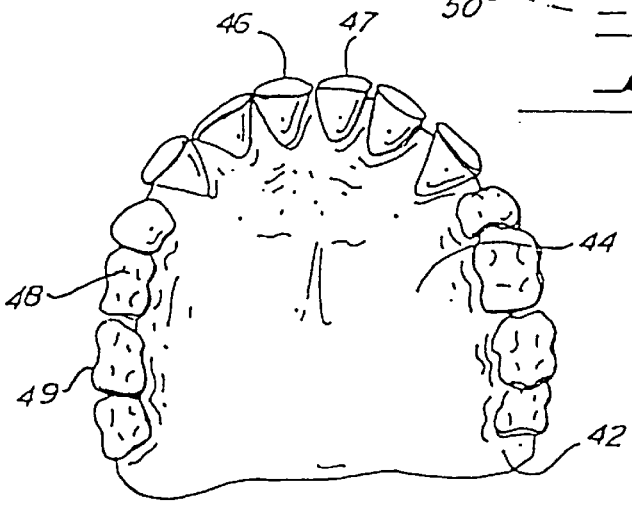
FIG. 1B is a top view of the lower jaw similar to an upper jaw, partially broken away.

To understand the structural features and benefits of the dental appliance 70 of the present invention, some anatomy will first be described. Referring to FIGS. 1 and 1A, the user or athlete has a mouth 10 generally comprised of a rigid upper jaw 12 and a movable lower jaw 42 which are movably connected at the temporomandibular joint (TMJ) 32 and 50. More specifically, the rigid upper jaw 12 has gum tissue 14 within mouth 10. Gum tissue 14, as well as the bone thereunder, supports anterior teeth (incisors and canines) 18 which have incisal or biting surfaces 19. The gum tissues 14 and the bone thereunder also support posterior teeth (molars and bicuspids) 22 which have cusps or biting surfaces 26.

Referring to one side of the human head, the temporal bone 28 is located upwardly and rearwardly of the upper jaw 12 and is in the range of 1/16 to 1/32 inch thick. The articular eminence 30 forms the beginning of the glenoid fossa 32 or the socket of the temporomandibular joint 32 and 50. Rearwardly and posteriorly to the articular eminence 30 is located cartilage or meniscus 34. Through the temporomandibular joint 32 and 50 pass the auriculo-temporalis nerve 36 and the supra-temporo artery 38. Posteriorly to this structure is located the inner ear 40. Within the mouth is located tongue 39 and the roof or hard palate 31, which terminates rearwardly into the soft palate.

The movable jaw or mandible 42 supports a bone covered by gum tissue 44 which further supports anterior teeth (incisors and canines) 46 with incisal or biting surfaces 47 and posterior teeth (molars and bicuspids) 48 with occlusal biting surfaces 49. The condyle 50 of the lower jaw 42 forms the ball of the temporomandibular joint 32 and 50. The anatomical structure is the same for both sides of the head.

Repeated impacts, collisions, blows, stress or forces exerted on the movable lower jaw 42 result in excessive wearing forces upon the condyle 50 and the cartilage or meniscus 34—typically resulting in deterioration or slippage of the cartilage 34. Thereafter, the lower jaw 42 may be subject to irregular movement, loss of comfortable range of movement, and clicking of the joint 32 and 50.

The auriculo-temporalis nerve 36 relates to both sensory and motor activity of the body. Any impingement or pinching of this nerve 36 can result in causing the brain to cause cessation of clenching activity, resulting in the loss of power. The supra-temporal artery 38 is important in that it provides blood circulation to the head. Impingement, pinching, rupture or blockage of this artery 38 will result in possible loss of consciousness and reduced physical ability and endurance due to the restriction of blood flow to the brain. Thus, it is extremely important to assure that the condyle 50 does not put pressure upon the bony structure around the auriculo-temporalis nerve 36 or the supra-temporal artery 38.

It is also important to note that glenoid fossa of the temporal bone 28 is not too thick. Medical science has known that a sharp shock, stress, or concussive force applied to the lower jaw 42 possibly could result in the condyle 50 protruding through the glenoid fossa of the temporal bone 28, thereby causing death. This incident rarely, but sometimes, occurs with respect to boxing athletes.

Referring to FIGS. 2 through 16, the adjustable customized composite dental appliance 70 may generally be seen.

The appliance 70 has posterior occlusal pads 71, each including a base 72. Base 72 is suitably made of a thermoplastic or thermoplastic rubber such a polyethylene, polypropylene, or Kraton® which is marketed by GLS Plastics of 740B Industrial Drive, Cary, Ill. 60013. These thermoplastics and thermoplastic rubber are unique in that they are injection moldable, FDA approved, and readily adhere with copolymers of ethylene and vinyl acetate. Furthermore, these materials have a melting or softening point significantly higher than that of EVA which will facilitate fitting of the dental appliance 70 to the user for the athlete's mouth 10. Furthermore, the thermoplastics and thermoplastic rubbers, unlike copolymers of ethylene and vinyl acetate, exhibit high resilients, low compression, shape maintenance and shock absorption, attenuation and dissipation. In fact, virtually all rubbers exhibit these physical characteristics which may be utilized for the posterior pad basis 72.

Figure 4:
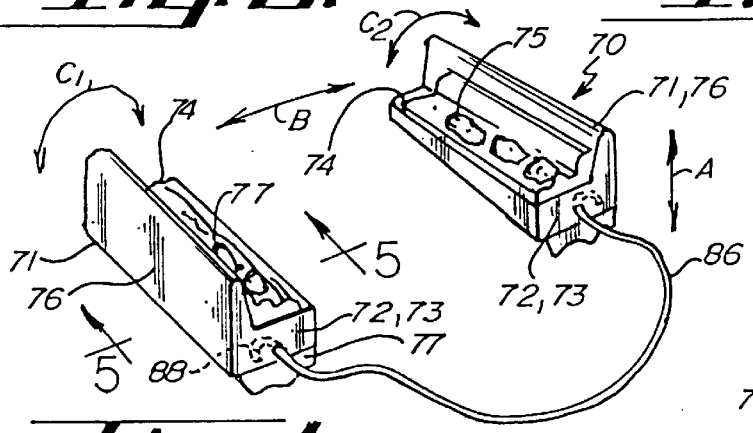
FIG. 4 is a perspective view of the dental appliance of the present invention.
Figure 5:
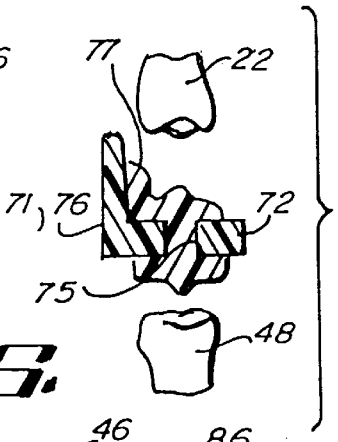
FIG. 5 is a cross section along the lines 5—5 of FIG. 4.

As can be seen in FIG. 4 specifically, the base 72 has a thicker front portion 73 and a thinner rear portion 74. The front is preferably approximately 2.5 millimeters thick while the rear is 1.5 millimeters approximately. By this arrangement, the mandible or lower jaw 42 is caused to slide forwardly and slightly downwardly while fitting the dental appliance 70. Also, the condyles 50 are moved downwardly and away from the fasciae or sockets 32 without the need for exotic devices and/or measurements, articulation, etc. Also, the front teeth 18 and 46 are appropriately slightly spaced apart while the adjustable band or wire 86 is clear of the tongue 39, which will readily permit the wearer to easily breathe in a power fashion, as well as convey the ability to speak clearly as further explained below.

Occlusal pads 71 suitably have slots or apertures 75 through their respective bases 72. Also, base 72 has an upwardly or downwardly extending labial wall 76. On both sides of bases 72 is a low temperature moldable thermoplastic such as ethylene vinyl acetate (EVA). EVA is a commercially available compound approved for oral use by the Food and Drug Administration. Other possible moldable materials include a light curing resin, which is soft when in the dark but becomes hardened when exposed to light. Such a light curing resin may preferably consist essentially of methyl methacrylate, chlorosulfonated polyethylene, fluoridated methacrylate, methacrylic acid, and photo initiators. A suitable light curing resin is available under the name Specra Tray™ from Ivoclar AG, Bendererstrasse 2, FL-9494 Shaan/Liechtenstein. Another possible moldable material may be Hydroplastic™ material from TAK Systems, P.O. Box 939, East Wareham, Mass. 02538.

Connecting band or wire 86 is preferably made of a titanium base alloy. The stabilizing alloying elements can include manganese, iron, chromium, cobalt, nickel, copper, aluminum, tin and zirconium. Such alloys may also be alpha-titanium or beta-titanium. These alloys exhibit ultra-elasticity and can be made with a memory shape which the wire alloy 86 will return to upon heating. Such a wire product may be obtained from Ultimate Wireforms, Inc., 200 Central Street, Bristol, Conn. 06010. The wire for connecting band 86 which connects the occlusal pads 71 may take other forms shown in FIGS. 14 through 16 and be made of an annealed metal, braided wire or electrical-like wire. That is, the connecting band or wire may take the form of two wires. The band 89 may have threaded ends 90 for threading into apertures within pads 71. Additionally, the wire 89 may have insulation 91 around a wire similar to an electrical wire. Further still, the wire may be of a braided 92 construction.

As shown in FIG. 4, the dental appliance 70 is readily adjustable along three axis shown along arrows A, B and C. That is, the bending of wire 86 permits vertical adjustment (arrow A), as well as a swinging outwardly and inwardly of the posterior occlusal pads 71 (arrow B). Additionally, the pads 71 may be twisted for correction of deformed dentitions (circular arrows $C_1$ and $C_2$).

Figure 2:
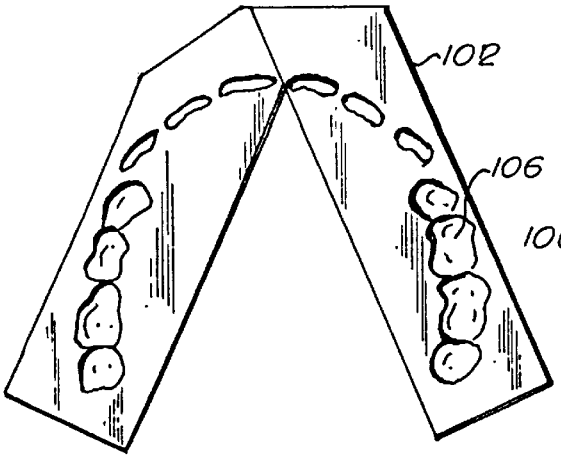
FIG. 2 is a top view of a sizing strip with a dentition imprint.
Figure 3:
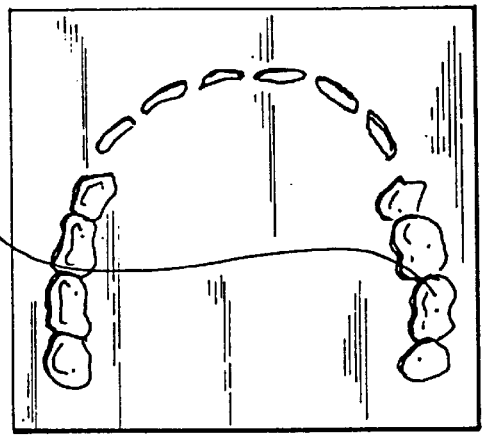
FIG. 3 is a top view of an alternative sizing medium with a dentition imprint.

To fit the appliance 70 to the wearer, an impression of the upper or lower teeth may first be taken as shown in FIG. 2, on a sizing strip 102, as has been described in U.S. Pat. No. 5,385,155, hereby incorporated by reference. This forms a dentition imprint 106 of the upper or lower teeth to which the appliance 70 is to be fitted. Alternatively, the dentition imprint 106 may be taken on any suitable medium 108, such as wax, cardboard, tinfoil, styrofoam, or paper, as shown in FIG. 3.

Figure 6:
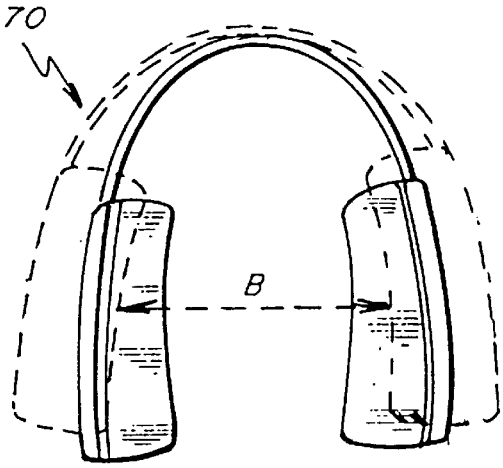
FIG. 6 is a top plan view of the dental appliance of the present invention with alternative positioning shown in phantom.
Figure 7:
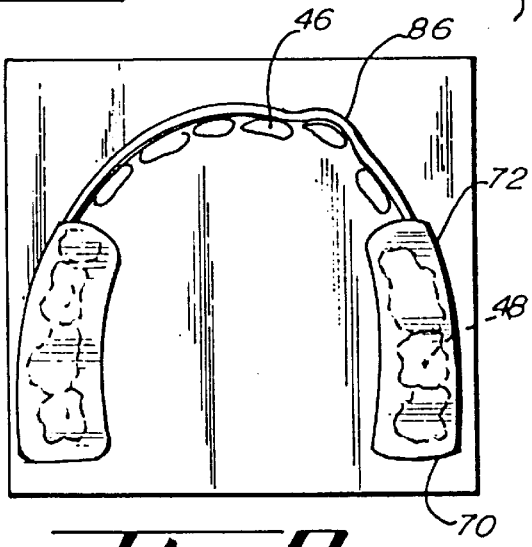
FIG. 7 is a top plan view of a sizing medium and dentition imprint with the dental appliance of the present invention overlaid thereon.

After the dental imprint 106 is taken, the appliance 70 is laid on top of the dental imprint 106 and the lateral separation (arrow B) between the posterior occlusal pads 71 is adjusted as is shown in FIG. 6. Additionally, the connecting wire 86 may be bent and adjusted to generally conform about the anterior teeth 18 or 46 and to accommodate irregularities as shown in FIG. 7.

Figure 9:
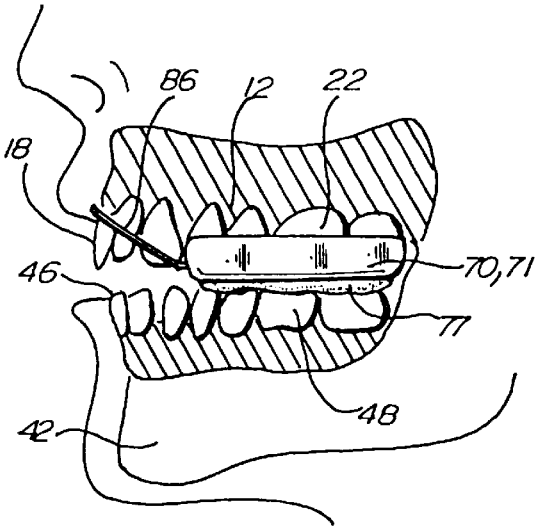
FIG. 9 is a side elevational view of the jaws of the user with structure broken away to show the dental appliance of the present invention being fitted to the upper jaw of the mouth.
Figure 8:
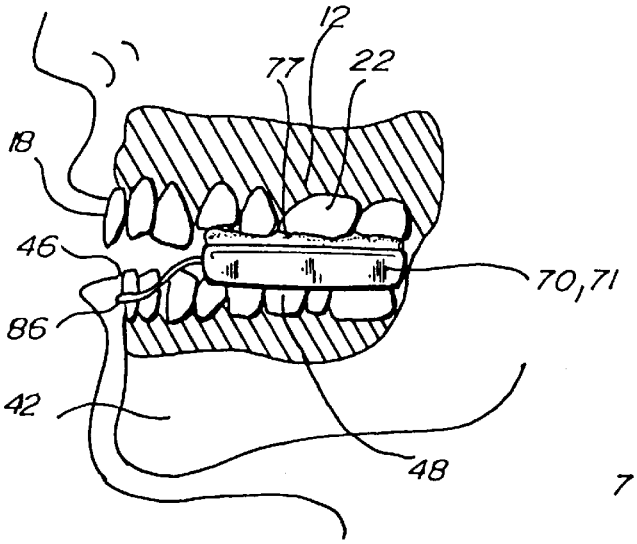
FIG. 8 is a side elevational view of the jaws of the user with structure broken away to show the dental appliance of the present invention being fitted to the lower jaw of the mouth.

Next, the appliance 70 is inserted into the mouth to assure proper alignment of the posterior occlusal pad 71 and the band or wire 86 as is shown in FIGS. 8 and 9 when fitting the appliance 70 on the lower teeth or upper teeth.

Figure 10:
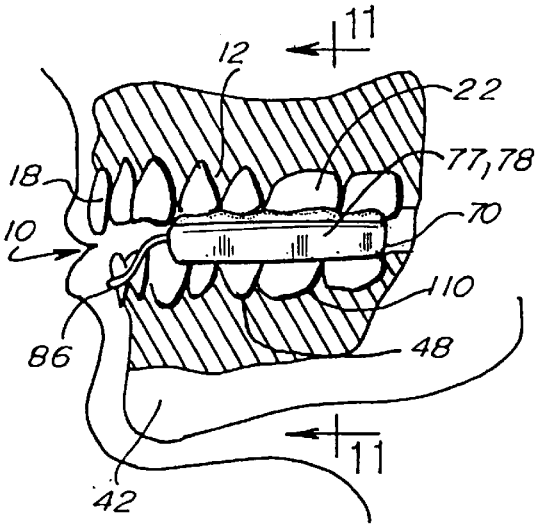
FIG. 10 is a side elevational view of the jaws of the user similar to FIG. 9 with the moldable material softened and being fitted to the teeth.

Next, the moldable thermoplastic 77 must be conformed to the posterior teeth 22 or 48. If the moldable material 77 is a low temperature thermoplastic such as ethylene vinyl acetate, the occlusal pads 71 of the appliance may be lowered into nearly boiling hot water momentarily removed and placed into the mouth. Thereafter, the mouth is closed and the wearer should apply suction while packing the appliance 70 with the hands along the cheeks adjacent to posterior teeth 48 as shown in FIG. 10.

Figure 11:
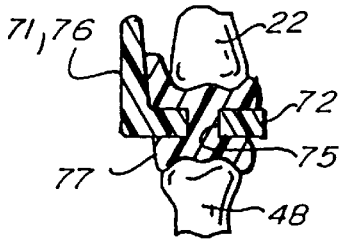
FIG. 11 is a cross section along the lines 11—11 of FIG. 10.
Figure 12:
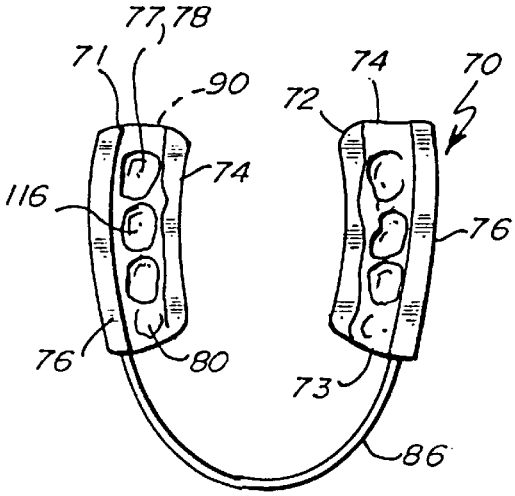
FIG. 12 is a top plan view of the dental appliance of the present invention with dentition imprints from the upper teeth.
Figure 13:
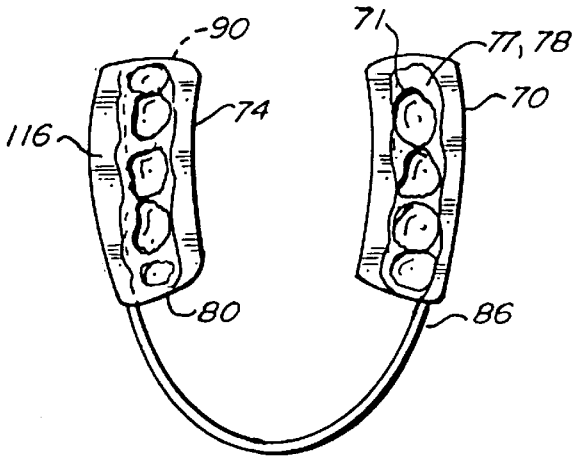
FIG. 13 is a bottom plan view of the appliance with dentition imprints from the lower teeth.

By this action, the user of the appliance 70 will have correct jaw posture for athletic participation once fitting has been completed. The posterior teeth 48 and 22 of the upper and lower jaw will have properly indexed and created imprints 78 in the moldable material 77 as is illustrated in FIGS. 11 through 13.

Should other moldable material be used, such as a light curing resin, the appliance 70 is removed from its light blocked packaging and fitted similarly, after which the appliance 70 is exposed to light to harden the material.

Figure 14:
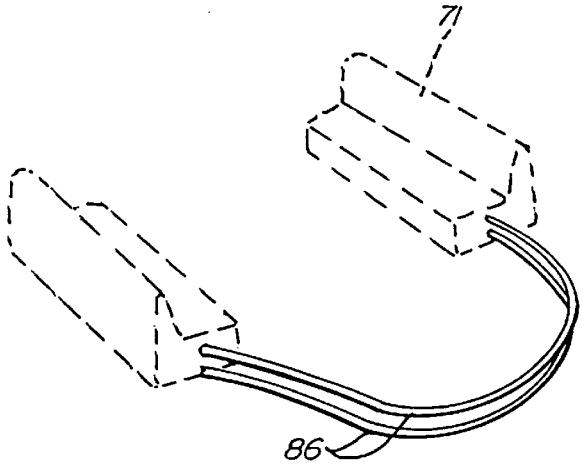
FIG. 14 is a perspective view of another embodiment of the connecting means for the posterior pads.
Figure 15:
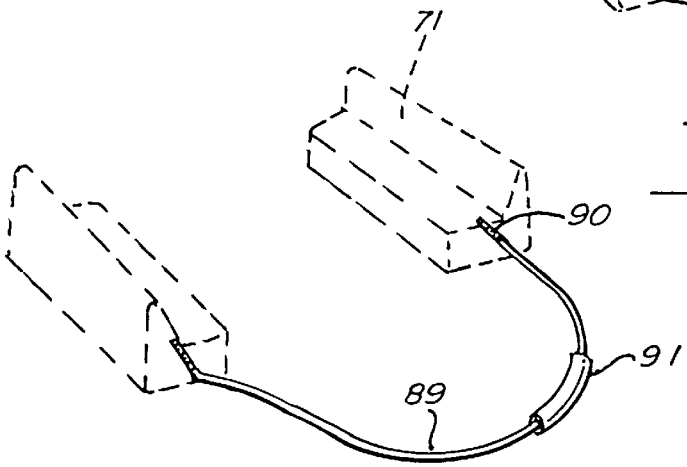
FIG. 15 is a perspective view of another embodiment of the connecting means for the posterior pads.
Figure 16:
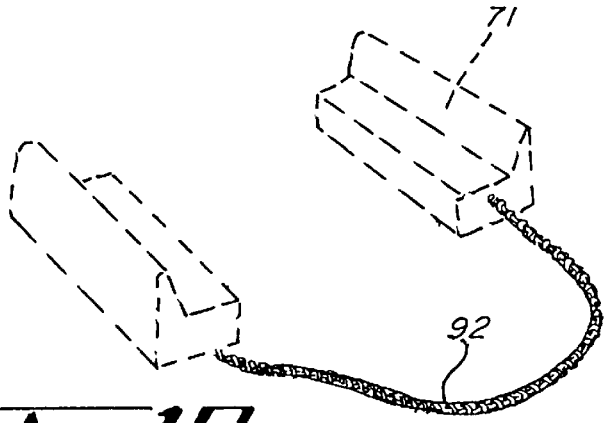
FIG. 16 is a perspective view of another embodiment of the connecting means for the posterior pads.

FIGS. 14 through 16 show additional embodiments of the connecting band or wire 86. For instance, two wires 86 may be used. A threaded wire 89 may be screwed into the posterior pads 77. Such a wire may be similar to an electrical wire with insulation. Also, the wire may be a woven design 92. The wire may also be annealed, resulting in a dead soft wire.

Figure 17:
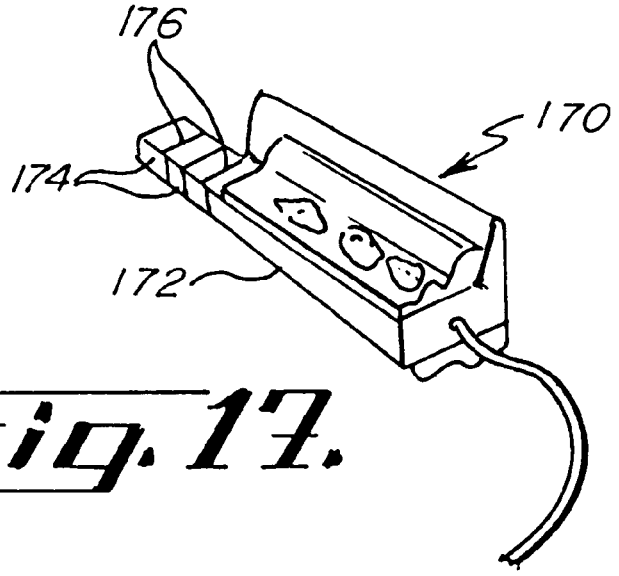
FIG. 17 is a perspective view of another embodiment with one occlusal pad broken away.

FIG. 17 shows a modified appliance 170 wherein the length of base 172 is adjustable in length. Specifically, tabs 174 have score lines 176 therebetween which may facilitate the breaking or cutting off of tabs 174 to shorten the appliance 170 to the desired length.

Figure 18:
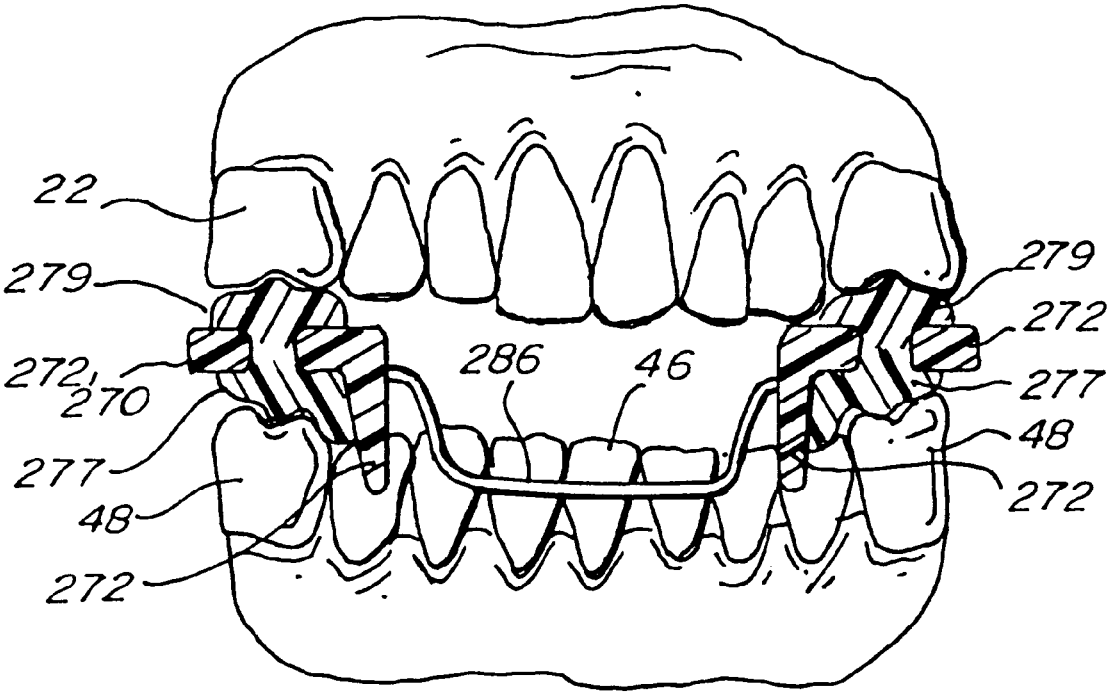
FIG. 18 is a cross sectional view of yet another embodiment taken from inside the mouth looking out.

FIG. 18 shows yet another modified appliance wherein the previously known labial wall 76 is replaced with a depending lingual wall 272. A lingual wall 272 facilitates an impressionable layer 277 in being fitted to the lower molar teeth 48. The somewhat impressionable layer 279 above will permit inner digitation thereat with the upper molar teeth 22. It is also noteworthy that the connecting band or wire 286 in this embodiment is along the inside or lingual side of the front lower teeth 46.

The impressionable layer 277 is softenable by heat and suitably made of approximately 50% of a Polycaprolactone polymer and a 50% composition of 151 ethylene vinyl acetate or EVA. The Polycaprolactone polymer is marketed under the name Hydroplastic™ and may be obtained from TAK Systems, P.O. Box 939, East Wareham, Mass. 02538 (disclosed in U.S. Pat. No. 5,112,225). However, this impressionable layer 277 may suitably be made solely of EVA.

The base 172 and depending lingual wall 272 is suitably made of a thermoplastic or thermoplastic rubber such as polyethylene, polypropylene, styrene, or the like that is more rigid to securely hold the looped end of band or wire 286 in place. The intermediate layer also has an aperture therethrough to permit an innerlocking of the moldable impressionable layer 277 to the somewhat impressionable layer 279. The somewhat impressionable layer 279 is suitably made of a thermoplastic elastomer such as a Kraton® and EVA composition. Kraton® is marketed by GLS Plastics of 740B Industrial Drive, Cary, Ill. 60013, and suitably has approximately a 50% portion of 150 EVA.

Thus, when the modified appliance 270 is immersed in hot water, the impressionable layer 277 becomes fairly soft while the somewhat impressionable layer 279 becomes somewhat soft to facilitate inter digitation of the upper and lower teeth 22 and 48 into the appliance 270.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

What is claimed:

1. An adjustable, customizable dental appliance, comprising:

a) a pair of left and right occlusal posterior composite pads for the posterior teeth of the upper or lower jaw, each occlusal posterior composite pad having opposing occlusal surfaces for contacting the occlusal surfaces of the posterior teeth of the upper and lower jaw;

b) each of the left and right occlusal posterior composite pads being of a triple composite construction and comprising an upper layer formed from an impressionable, softenable thermoplastic material; a middle layer formed from a non-impressionable thermoplastic material; and a lower layer formed from an impressionable, softenable thermoplastic material distinct from the material of the upper layer; and c) a connecting portion connecting the left and right occlusal posterior composite pads together within the mouth, the connecting portion for lying along and adjacent the lingual side of the anterior teeth of the lower jaw, the connecting portion being adjustable from side to side to adapt to the lateral spacing between the two sets of posterior teeth.

2. The adjustable, customizable dental appliance of claim 1, wherein the connecting portion further comprises an arcuate portion constructed of a flexible material.

3. The adjustable, customizable dental appliance of claim 1, further comprising a slot through the middle layer to interlock the upper and lower layers.

4. An adjustable, customizable dental appliance, comprising:

a) a pair of left and right occlusal posterior composite pads for the posterior teeth of the upper or lower jaw, each occlusal posterior composite pad having opposing occlusal surfaces for contacting the occlusal surfaces of the posterior teeth of the upper and lower jaw;

b) each of the left and right occlusal posterior composite pads being of a triple composite construction and comprising an upper layer formed from an impressionable, softenable thermoplastic material; a middle layer formed from a non-impressionable thermoplastic material; and a lower layer formed from an impressionable, softenable thermoplastic material distinct from the material of the upper layer; and c) a connecting portion connecting the left and right occlusal posterior composite pads together within the mouth, the connecting portion for lying along and adjacent the lingual side of the anterior teeth of the lower jaw, the connecting portion being adjustable from side to side to adapt to the lateral spacing between the two sets of posterior teeth wherein the connecting portion further comprises an arcuate portion constructed of a flexible material.

5. The adjustable, customizable dental appliance of claim 4, further comprising a slot through the middle layer to interlock the upper and lower layers.

6. An adjustable, customizable dental appliance, comprising:

a) a pair of left and right occlusal posterior composite pads for the posterior teeth of the upper or lower jaw, each occlusal posterior composite pad having opposing occlusal surfaces for contacting the occlusal surfaces of the posterior teeth of the upper and lower jaw;

b) each of the left and right occlusal posterior composite pads being of a triple composite construction and comprising an upper layer formed from an impressionable, softenable thermoplastic material; a middle layer formed from a non-impressionable thermoplastic material; and a lower layer formed from an impressionable, softenable thermoplastic material distinct from the material of the upper layer; further comprising a slot through the middle layer to interlock the upper and lower layers; and c) a connecting portion connecting the left and right occlusal posterior composite pads together within the mouth, the connecting portion for lying along and adjacent the lingual side of the anterior teeth of the lower jaw, the connecting portion being adjustable from side to side to adapt to the lateral spacing between the two sets of posterior teeth wherein the connecting portion further comprises an arcuate portion constructed of a flexible material.

7. The adjustable, customizable dental appliance of claim 6, wherein the material of the lower layer further comprises a composition of about 50% polycaprolactone polymer and 50% EVA.

8. The adjustable, customizable dental appliance of claim 7, wherein the material of the upper layer further comprises a composition of about 50% thermoplastic elastomer other than polycaprolactone polymer and 50% EVA.

* * * * *